US011407241B2

(12) United States Patent
Yasukawa et al.

(10) Patent No.: US 11,407,241 B2
(45) Date of Patent: Aug. 9, 2022

(54) MEDIUM CONVEYING APPARATUS FOR DRIVING BRAKE ROLLER AND CONVEYING ROLLER PAIR BY USING SINGLE MOTOR

(71) Applicant: PFU LIMITED, Kahoku (JP)

(72) Inventors: Ryoichi Yasukawa, Kahoku (JP); Tomofumi Kumahashi, Kahoku (JP)

(73) Assignee: PFU Limited, Ishikawa (JP)

( * ) Notice: Subject to any disclaimer, the term of this patent is extended or adjusted under 35 U.S.C. 154(b) by 215 days.

(21) Appl. No.: 16/926,277

(22) Filed: Jul. 10, 2020

(65) Prior Publication Data

US 2021/0187977 A1 Jun. 24, 2021

(30) Foreign Application Priority Data

Dec. 19, 2019 (JP) ..... JP2019-229543

(51) Int. Cl.
*B41J 13/00* (2006.01)
*B65H 3/52* (2006.01)

(52) U.S. Cl.
CPC ..... *B41J 13/0009* (2013.01); *B65H 3/5284* (2013.01)

(58) Field of Classification Search
CPC ..... B41J 13/0009; B41J 29/38; B41J 11/04; B65H 3/063; B65H 7/12; B65H 3/5284; B65H 2801/12; B65H 2801/15
See application file for complete search history.

(56) References Cited

U.S. PATENT DOCUMENTS

2013/0234387 A1* 9/2013 Moto ..... B65H 9/002 271/228
2013/0241144 A1* 9/2013 Yasukawa ..... B65H 7/12 271/272

(Continued)

FOREIGN PATENT DOCUMENTS

JP 2012-188279 A 10/2012
JP 2018-16483 A 2/2018
JP 2019-116383 A 7/2019

OTHER PUBLICATIONS

Japanese Office Action dated Jul. 27, 2020 (dated Aug. 4, 2020) regarding Japanese Patent Application No. 2019-229543 corresponding to U.S. Appl. No. 16/926,277 (2 pages) with English Translation (3 pages).

*Primary Examiner* — Jannelle M Lebron
(74) *Attorney, Agent, or Firm* — Lewis Roca Rothgerber Christie LLP

(57) ABSTRACT

A medium conveying apparatus includes a driving force transmitting mechanism to transmit a driving force from a first motor to a brake roller and a pair of conveyance rollers located on the downstream side of the brake roller, and a processor to rotate the first motor forward to control so that a medium separated by the brake roller is conveyed by the pair of conveyance rollers, in a separation mode. The processor rotates the first motor backward to perform a feed operation by the brake roller and rotate the pair of conveyance rollers backward until a front edge of the medium passes through a position of the brake roller, and rotates the first motor forward to control so that the medium is conveyed by the pair of conveyance rollers after the front edge of the medium passes through the position of the brake roller, in a non-separation mode.

12 Claims, 11 Drawing Sheets

(56) References Cited

U.S. PATENT DOCUMENTS

| | | | | |
|---|---|---|---|---|
| 2014/0110898 | A1* | 4/2014 | Hung | B65H 3/5284 271/10.11 |
| 2018/0029815 | A1 | 2/2018 | Yonemura | |
| 2019/0193967 | A1 | 6/2019 | Shuto et al. | |

* cited by examiner

MEDIUM CONVEYING APPARATUS FOR DRIVING BRAKE ROLLER AND CONVEYING ROLLER PAIR BY USING SINGLE MOTOR

CROSS-REFERENCE TO RELATED APPLICATIONS

This application is based upon and claims the benefit of priority of prior Japanese Patent Application No. 2019-229543, filed on Dec. 19, 2019, the entire contents of which are incorporated herein by reference.

TECHNICAL FIELD

Embodiments discussed in the present specification relate to medium conveyance.

BACKGROUND

Recently, in a medium conveying device such as a scanner, it is required to convey not only paper but also a plastic card, a passport, etc., as a medium. In a medium conveying apparatus that supports a conveyance of various types of media, a separation mode for separating and conveying the media and a non-separation mode for conveying the media without separating are provided. Further, such a medium conveying apparatus has a plurality of rollers to convey the medium. In order to suppress an increase in power consumption, the plurality of rollers are rotated by a single motor. However, when rotating the plurality of rollers with the single motor, it is not easy to appropriately control a rotation of the plurality of rollers of which purposes are different from each other by the single motor since the other rollers also rotate simultaneously when rotating a particular roller.

A sheet feeding device having a sheet stacking unit on which sheets are stacked, and a feeding unit capable of switching between a separating mode for feeding and separating a sheet one by one from the sheet stacking unit and a non-separating mode for feeding a sheet without separating is disclosed (Japanese Unexamined Patent Publication (Kokai) No. 2012-188279). This sheet feeding device switches a sheet feeding mode by the feeding unit based on a detection result of a movement of the sheets on the sheet stacking unit.

A medium feeding device in which the separating roller is rotated by a predetermined amount of rotation in a first rotation direction before an execution of a separating mode after start of feeding by a feed roller, so that the front edge s of a plurality of sheets are in a state of being separated by being displaced, is disclosed (Japanese Unexamined Patent Publication (Kokai) No. 2019-116383). This medium feeding device maintains the rotation of the feed roller in the feeding direction from this state and rotates a separating roller in a second rotation direction.

SUMMARY

According to some embodiments, a medium conveying apparatus includes a brake roller, a pair of conveyance rollers located on the downstream side of the brake roller in a medium conveying direction, a first motor, a driving force transmitting mechanism to transmit a driving force from the first motor to the brake roller and the pair of conveyance rollers, and a processor to rotate the first motor forward to control so that a medium separated by the brake roller is conveyed by the pair of conveyance rollers, in a separation mode. The processor rotates the first motor backward to perform a feed operation by the brake roller and rotate the pair of conveyance rollers backward until a front edge of the medium passes through a position of the brake roller, and rotates the first motor forward to control so that the medium is conveyed by the pair of conveyance rollers after the front edge of the medium passes through the position of the brake roller, in a non-separation mode.

According to some embodiments, a method for controlling conveying a medium includes transmitting a driving force from a first motor to a brake roller and a pair of conveyance rollers located on the downstream side of the brake roller in a medium conveying direction, by a driving force transmitting mechanism, rotating the first motor forward to control so that a medium separated by the brake roller is conveyed by the pair of conveyance rollers, in a separation mode; and rotating the first motor backward to perform a feed operation by the brake roller and rotate the pair of conveyance rollers backward until a front edge of the medium passes through a position of the brake roller, and rotating the first motor forward to control so that the medium is conveyed by the pair of conveyance rollers after the front edge of the medium passes through the position of the brake roller, in a non-separation mode.

According to some embodiments, a computer-readable, non-transitory medium stores a computer program. The computer program causes a medium conveying apparatus including a brake roller, a pair of conveyance rollers located on the downstream side of the brake roller in a medium conveying direction, a first motor, and a driving force transmitting mechanism to transmit a driving force from the first motor to the brake roller and the pair of conveyance rollers, to execute a process including rotating the first motor forward to control so that a medium separated by the brake roller is conveyed by the pair of conveyance rollers, in a separation mode; and rotating the first motor backward to perform a feed operation by the brake roller and rotate the pair of conveyance rollers backward until a front edge of the medium passes through a position of the brake roller, and rotating the first motor forward to control so that the medium is conveyed by the pair of conveyance rollers after the front edge of the medium passes through the position of the brake roller, in a non-separation mode.

DESCRIPTION OF EMBODIMENTS

It is to be understood that both the foregoing general description and the following detailed description are exemplary and explanatory, and are not restrictive of the invention, as claimed.

Hereinafter, a medium conveying apparatus, a method and a computer-readable, non-transitory medium storing a computer program according to an embodiment, will be described with reference to the drawings. However, it should be noted that the technical scope of the invention is not limited to these embodiments, and extends to the inventions described in the claims and their equivalents.

Figure 1:
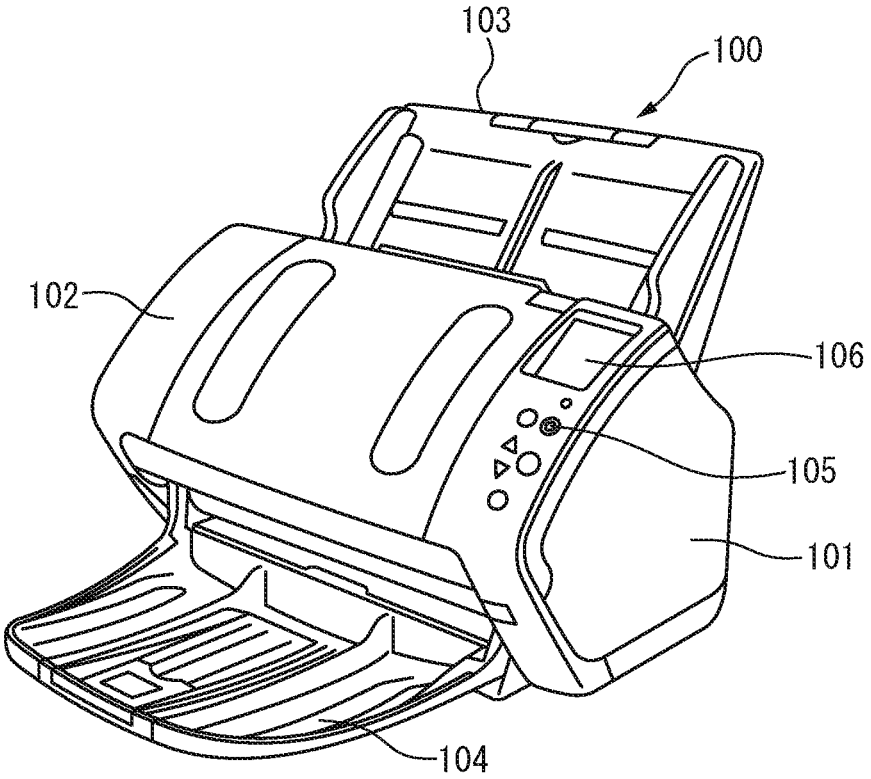
FIG. 1 is a perspective view illustrating a medium conveying apparatus 100 according to an embodiment.

FIG. 1 is a perspective view illustrating a medium conveying apparatus 100 configured as an image scanner. The medium conveying apparatus 100 conveys and images a medium being a document. The medium is a paper or a thick medium (e.g., a medium having a thickness greater than 2 mm) such as a thick paper, a card, a brochures, or a passport. The medium conveying apparatus 100 may be a fax machine, a copying machine, a multifunctional peripheral (MFP), etc. A conveyed medium may not be a document but may be an object being printed on etc., and the medium conveying apparatus 100 may be a printer etc.

The medium conveying apparatus 100 includes a lower housing 101, an upper housing 102, a medium tray 103, an ejection tray 104, an operation device 105, and a display device 106.

The upper housing 102 is located at a position covering the upper surface of the medium conveying apparatus 100 and is engaged with the lower housing 101 by hinges so as to be opened and closed at a time of medium jam, during cleaning the inside of the medium conveying apparatus 100, etc.

The medium tray 103 is engaged with the lower housing 101 in such a way as to be able to place a medium to be conveyed. The ejection tray 104 is engaged with the lower housing 101 in such a way as to be able to hold an ejected medium.

The operation device 105 includes an input device such as a button, and an interface circuit acquiring a signal from the input device, receives an input operation by a user, and outputs an operation signal based on the input operation by the user. The display device 106 includes a display including a liquid crystal or organic electroluminescence (EL), and an interface circuit for outputting image data to the display, and displays the image data on the display.

Figure 2:
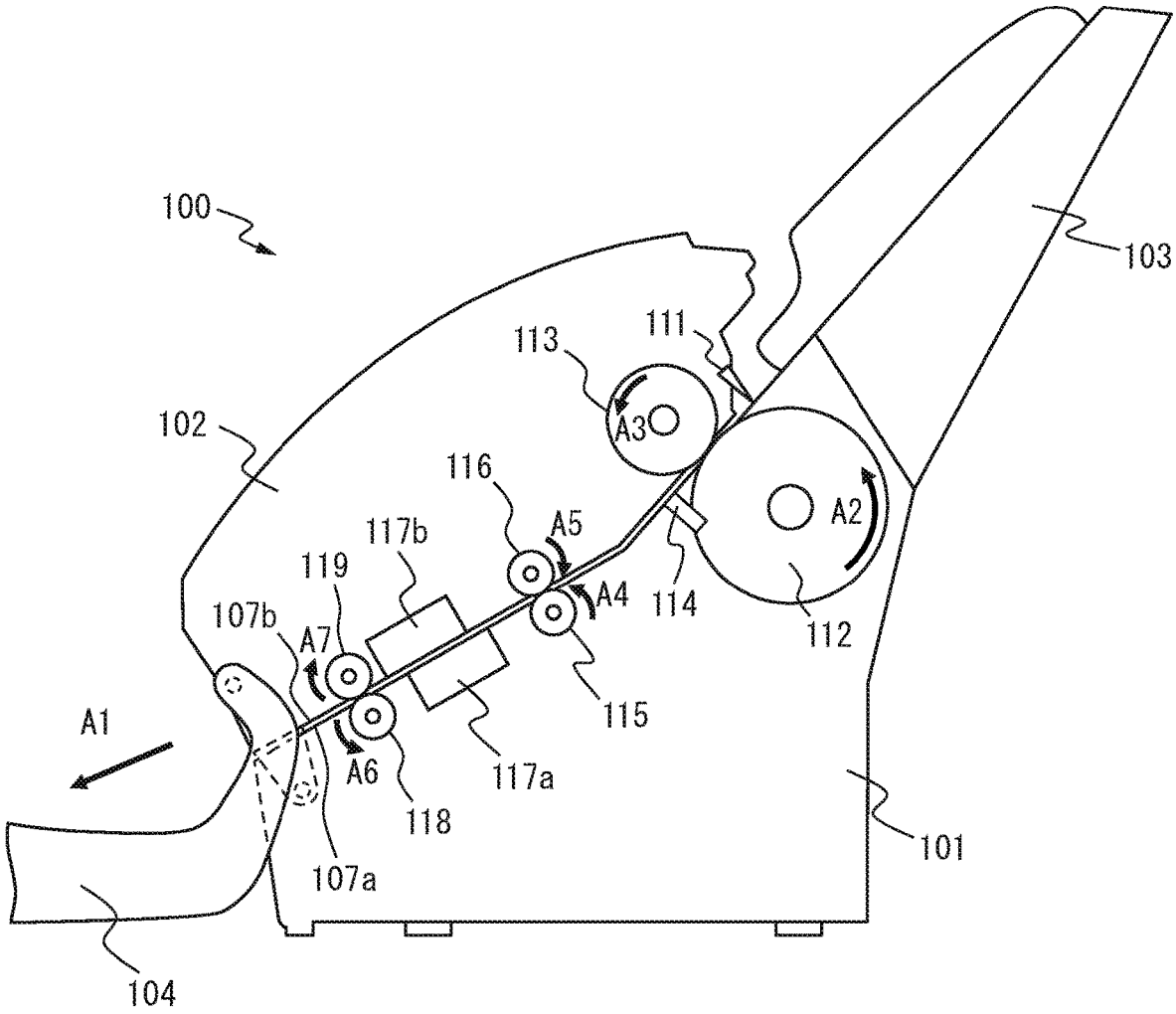
FIG. 2 is a diagram for illustrating a conveyance path inside the medium conveying apparatus 100.

FIG. 2 is a diagram for illustrating a conveyance path inside the medium conveying apparatus 100.

The conveyance path insides the medium conveying apparatus 100 includes a first sensor 111, a feed roller 112, a brake roller 113, a second sensor 114, a first conveyance roller 115, a second conveyance roller 116, a first imaging device 117*a*, a second imaging device 117*b*, a third conveyance roller 118 and a fourth conveyance roller 119, etc. The numbers of each roller is not limited to one, and may be plural.

A top surface of the lower housing 101 forms a lower guide 107*a* of a conveyance path of a medium, and a bottom surface of the upper housing 102 forms an upper guide 107*b* of the conveyance path of a medium. An arrow A1 in FIG. 2 indicates a medium conveying direction. An upstream hereinafter refers to an upstream in the medium conveying direction A1, and a downstream refers to a downstream in the medium conveying direction A1.

The first sensor 111 is located upstream of the feed roller 112 and the brake roller 113. The first sensor 111 includes a contact detection sensor and detects whether or not a medium is placed on the medium tray 103. The first sensor 111 generates and outputs a first medium signal whose signal value changes between a state in which a medium is placed on the medium tray 103 and a state in which a medium is not placed.

The feed rollers 112 are provided on the lower housing 101 and sequentially feed media placed on the medium tray 103 from the lower side. The brake roller 113 is provided in the upper housing 102 and is located to face the feed roller 112.

The second sensor 114 is located downstream of the feed roller 112 and the brake roller 113 and upstream of the first conveyance roller 115 and the second conveyance roller 116 in the medium conveying direction A1. The second sensor 114 is an example of a medium sensor, and detects whether or not a medium exists at the position, and detects a medium passing through between the feed roller 112 and the brake roller 113, and the first conveyance roller 115 and the second conveyance roller 116. The second sensor 114 includes a light emitter and a light receiver provided on one side with respect to the conveyance path of the medium, and a reflection member such as a mirror provided at a position facing the light emitter and the light receiver with the conveyance path in between. The light emitter emits light toward the conveyance path. On the other hand, the light receiver receives the light emitted by the light emitter and reflected by the reflection member, and generates and outputs a second medium signal being an electric signal based on intensity of the received light. Since the light emitted by the light emitter is shielded by the medium when the medium is present at the position of the second sensor 114, the signal value of the second medium signal is changed in a state where the medium is present at the position of the second sensor 114 and a state where the medium is not present. The light emitter and the light receiver may be provided at positions facing one another with the conveyance path in between, and the reflection member may be omitted.

The first conveyance roller 115 is provided in the lower housing 101. The second conveyance roller 116 is provided in the upper housing 102, and is located to face the first conveyance roller 115. The first and second conveyance rollers 115 and 116 are examples of a pair of conveyance rollers, which are located on the downstream side of the feed roller 112 and the brake roller 113 in the medium conveying direction A1, and convey the medium fed by the feed roller 112 and the brake roller 113 to the downstream side.

The first imaging device 117*a* includes a line sensor based on a unity-magnification optical system type contact image sensor (CIS) including an imaging element based on a complementary metal oxide semiconductor (CMOS) linearly located in a main scanning direction. Further, the first imaging device 117*a* includes a lens for forming an image on the imaging element, and an AM converter for amplifying and analog-digital (A/D) converting an electric signal output from the imaging element. The first imaging device 117*a* generates and outputs an input image imaging a front side of a conveyed medium, in accordance with control from a processing circuit to be described later.

Similarly, the second imaging device 118*b* includes a line sensor based on a unity-magnification optical system type CIS including an imaging element based on a CMOS linearly located in a main scanning direction. Further, the secondary imaging device 117*b* includes a lens for forming an image on the imaging element, and an A/D converter for amplifying and A/D converting an electric signal output from the imaging element. The secondary imaging device 117*b* generates and outputs an input image imaging a back side of a conveyed medium, in accordance with control from a processing circuit to be described later.

Only either of the first imaging device 117*a* and the second imaging device 117*b* may be located in the medium conveying apparatus 100 and only one side of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs. The first imaging device 117*a* and the second imaging device 117*b* may be collectively referred to as imaging devices 117.

The third conveyance roller 118 is provided in the lower housing 101. The fourth conveyance roller 119 is provided in the upper housing 102, and is located to face the third conveyance roller 118. The third and fourth conveyance rollers 118 and 119 are examples of a pair of conveyance rollers, which are located on the downstream side of the first and second conveyance rollers 115 and 116 in the medium conveying direction A1, and convey the media conveyed by the first and second conveyance rollers 115 and 116 to the downstream side.

A medium placed on the medium tray 103 is conveyed between the lower guide 107*a* and the upper guide 107*b* in the medium conveying direction A1 by the feed rollers 112 rotating in a direction of an arrow A2 in FIG. 2, that is, a medium feeding direction. When a medium is conveyed, the brake rollers 113 rotate in a direction of an arrow A3, that is, a direction opposite to the medium feeding direction. By the workings of the feed rollers 112 and the brake rollers 113, when a plurality of media are placed on the medium tray 103, only a medium in contact with the feed rollers 112, out of the media placed on the medium tray 103, is separated. Consequently, the medium conveying apparatus 100 operates in such a way that conveyance of a medium other than the separated medium is restricted (prevention of multi-feed).

A medium is fed between the first conveyance roller 115 and the second conveyance roller 116 while being guided by the lower guide 107*a* and the upper guide 107*b*. The medium is fed between the first imaging device 117*a* and the second imaging device 117*b* by the first conveyance roller 115 and the second conveyance roller 116 rotating in the directions of arrows A4 and A5, respectively. The medium read by the imaging device 117 is ejected on the ejection tray 104 by rotating the third conveyance roller 118 and the fourth conveyance roller 119 in the directions of arrows A6 and A7, respectively.

Figure 3:
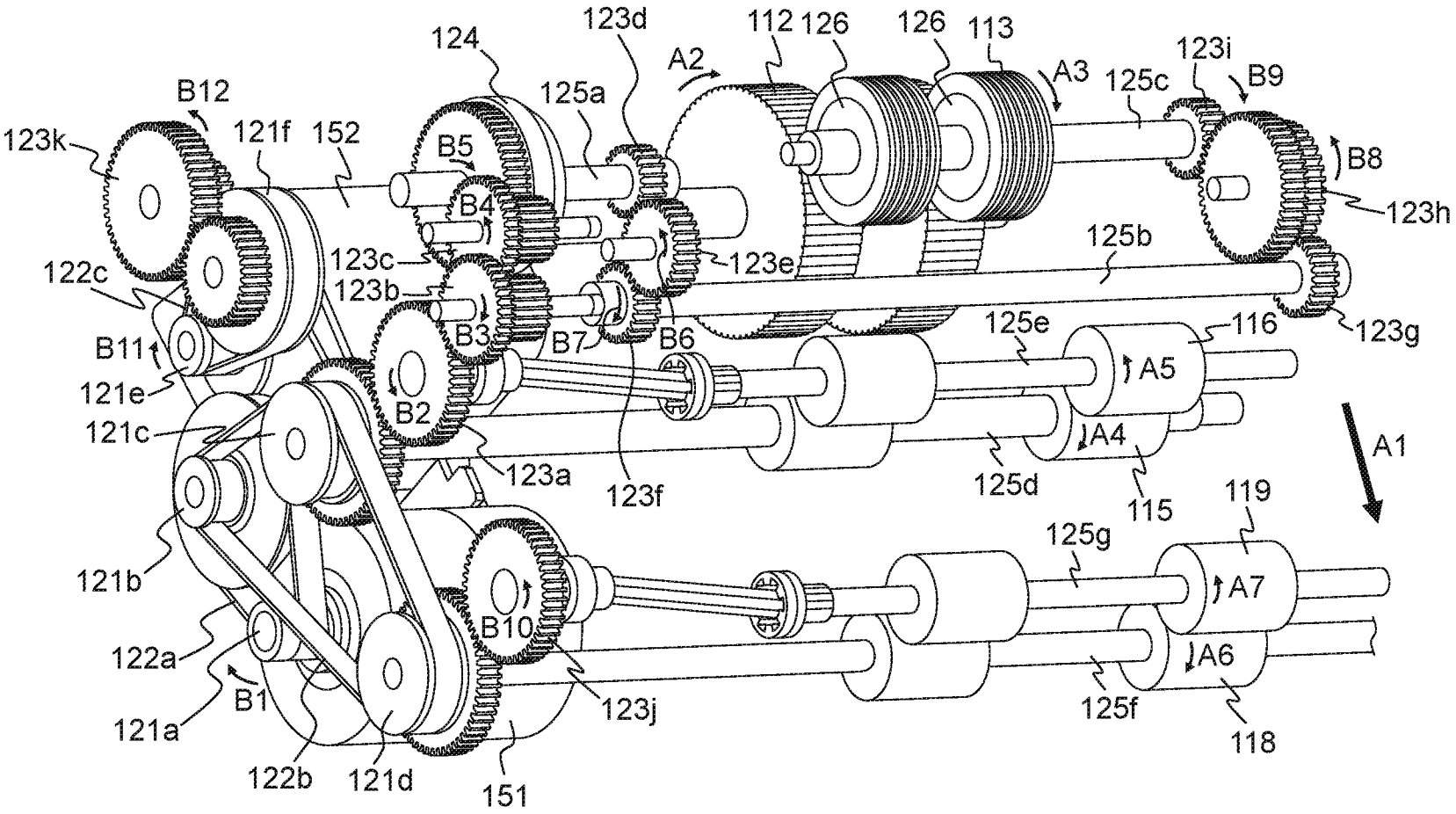
FIG. 3 is a schematic diagram for illustrating a driving mechanism of each roller.
Figure 4:
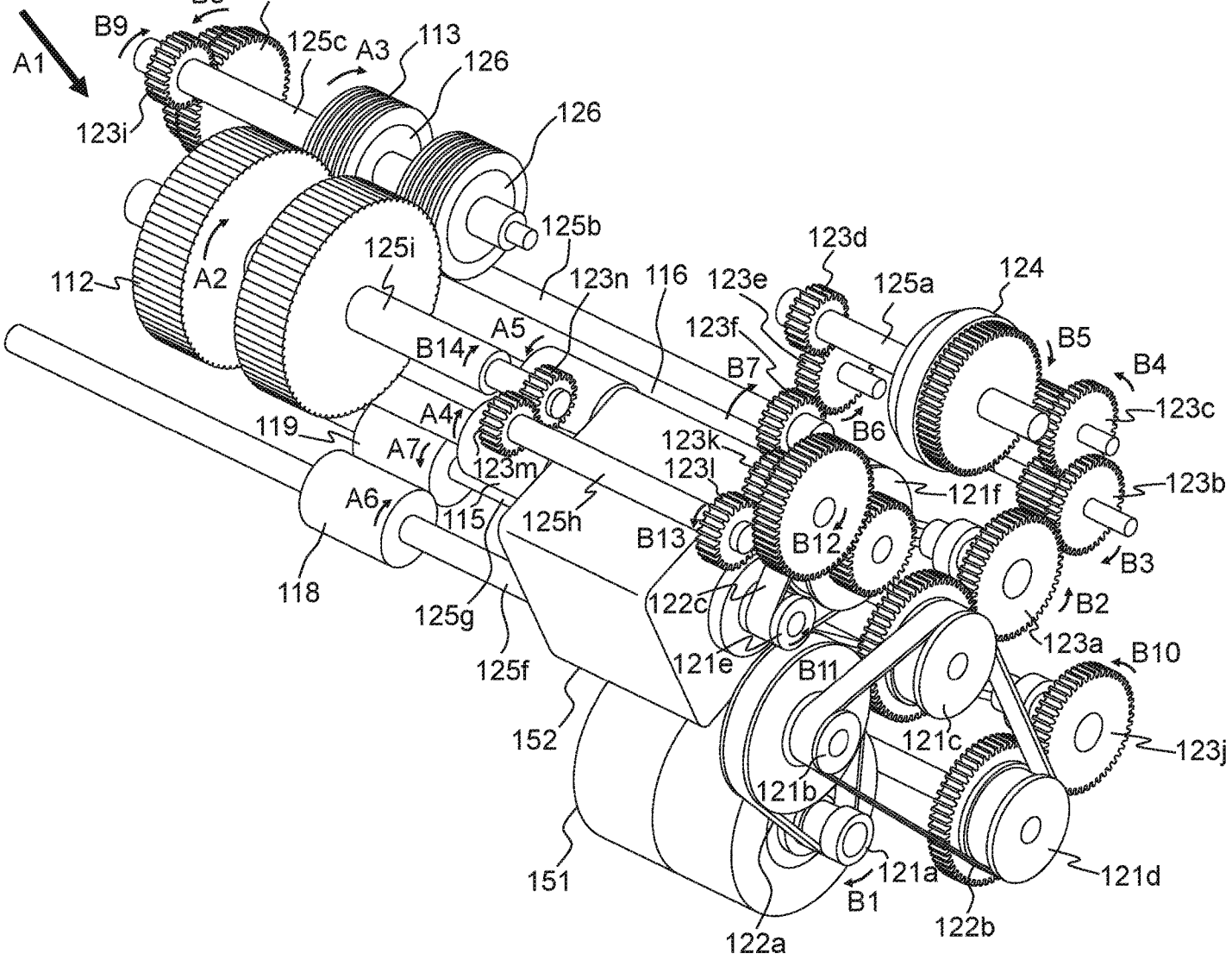
FIG. 4 is a schematic diagram for illustrating a driving mechanism of each roller.

FIGS. 3 and 4 are schematic views for illustrating a driving mechanism of the feed roller 112, the brake roller 113, and the first to fourth conveyance rollers 115, 116, 118, and 119. FIG. 3 is a perspective view of the driving mechanism of each roller from above the conveyance path, and FIG. 4 is a perspective view of the driving mechanism of each roller from the upstream side of the conveyance path.

As shown in FIGS. 3 and 4, the driving mechanism of the brake roller 113 and the first to fourth conveyance rollers 115, 116, 118, and 119 includes a first motor 151, first to fourth pulleys 121*a* to 121*d*, first to second belts 122*a* to 122*b*, first to tenth gears 123*a* to 123*j*, an electromagnetic clutch 124, first to seventh shafts 125*a* to 125*g*, torque limiters 126, etc. On the other hand, the driving mechanism of the feed roller 112 has a second motor 152, a fifth to sixth pulley 121*e* to 121*f*, a third belt 122*c*, an eleventh to fourteenth gears 123*k* to 123*n* and eighth to ninth shafts 125*h* to 125*i*, etc.

The first motor 151 generates a driving force for rotating the brake roller 113 and the first to fourth conveyance rollers 115, 116, 118, and 119 by a control signal from a processing circuit to be described later. The first to fourth pulleys 121*a* to 121*d*, the first to second belts 122*a* to 122*b*, the first to tenth gears 123*a* to 123*j*, the electromagnetic clutch 124, the first to seventh shafts 125*a* to 125*g* and the torque limiter 126 are examples of driving force transmission mechanism to transmit the driving force from the first motor 151 to brake roller 113 and first to fourth conveyance rollers 115, 116, 118, 119.

The first pulley 121*a* is attached to a rotation shaft of the first motor 151, and a first belt 122*a* is stretched between the first pulley 121*a* and a pulley portion having a larger outer diameter of the second pulley 121*b*. The second belt 122*b* is stretched between a pulley portion having the smaller outer diameter of the second pulley 121*b*, a pulley portion of the third pulley 121*c*, and a pulley portion of the fourth pulley 121*d*.

A gear portion of the third pulley 121*c* is engaged with the first gear 123*a*. The first gear 123*a* is engaged with the second gear 123*b*, the second gear 123*b* is engaged with the third gear 123*c*, and the third gear 123*c* is engaged with the electromagnetic clutch 124. The electromagnetic clutch 124 is attached to the first shaft 125*a*, and the fourth gear 123*d* is further attached to the first shaft 125*a*. The fourth gear 123*d* is engaged with the fifth gear 123*e*, and the fifth gear 123*e* is engaged with the sixth gear 123*f*. The sixth gear 123*f* is attached to the second shaft 125*b*, and the seventh gear 123*g* is further attached to the second shaft 125*b*. The seventh gear 123*g* is engaged with the eighth gear 123*h*, and the eighth gear 123*h* is engaged with the ninth gear 123*i*. The ninth gear 123*i* is attached to the third shaft 125*c*, and the brake roller 113 is further attached to the third shaft 125*c* via the torque limiter 126.

The third pulley 121*c* is attached to the fourth shaft 125*d*, and the first conveyance roller 115 is further attached to the fourth shaft 125*d*. The first gear 123*a* is attached to the fifth shaft 125*e*, and the second conveyance roller 116 is further attached to the fifth shaft 125*e*. The fourth pulley 121*d* is attached to the sixth shaft 125*f*, and the third conveyance roller 118 is further attached to the sixth shaft 125*f*. A gear portion of the fourth pulley 121*d* is engaged with the tenth gear 123*j*. The tenth gear 123*j* is attached to the seventh shaft 125*g*, and the fourth conveyance roller 119 is further attached to the seventh shaft 125*g*.

The second motor 152 generates a driving force for rotating the feed roller 112 by a control signal from the processing circuit to be described later. The fifth to sixth pulleys 121*e* to 121*f*, the third belt 122*c*, the eleventh to fourteenth gears 123*k* to 123*n* and the eighth to ninth shafts 125*h* to 125*i* are examples of the second driving force transmission mechanism to transmit the driving force from the second motor 152 to the feed roller 112.

The fifth pulley 121*e* is attached to a rotation shaft of the second motor 152, and the third belt 122*c* is stretched between the fifth pulley 121*e* and a pulley portion of the sixth pulley 121*f*. A gear portion of the sixth pulley 121*f* is engaged with the eleventh gear 123*k*, and the eleventh gear 123*k* is engaged with the twelfth gear 123*l*. The twelfth gear 123*l* is attached to the eighth shaft 125*h*, and the thirteenth gear 123*m* is further attached to the eighth shaft 125*h*. The thirteenth gear 123*m* is engaged with the fourteenth gear 123*n*. The fourteenth gear 123*n* is attached to the ninth shaft 125*i*, and the feed roller 112 is further attached to the ninth shaft 125*i*.

Hereinafter, the operations of each roller and the driving mechanism of each roller will be described.

The first motor 151, as a driving force, generates a first driving force by forward rotation (rotation in the first direction), and generates a second driving force by backward rotation (rotation in the second direction opposite to the first direction). The forward rotation is a rotation for rotating the first pulley 121*a* in the direction of arrow B1, and the backward rotation is a rotation for rotating the first pulley 121*a* in the direction opposite to the arrow B1.

When the first motor 151 generates the first driving force, the first pulley 121*a* rotates in the direction of arrow B1, accompanied by the rotation of the second to fourth pulley 121*b* to 121*d* in the direction of the arrow 91, respectively. The first to third gears 123*a* to 123*c* and the electromagnetic clutch 124 rotate in the directions of arrows B2 to B5, respectively, the fourth to sixth gears 123*d* to 123*f* rotate in the directions of arrows B5 to B7, respectively, and the seventh to ninth gears 123*g* to 123*i* rotate in the directions of the arrows B7 to B9, respectively. As a result, the brake roller 113 is rotated in the direction A3 opposite to the medium feeding direction by the first driving force from the first motor 151.

The limit value of the torque limiter 126 is set so that the rotational force through the torque limiter 126 is lost when one medium is fed, the rotational force through the torque limiter 126 is transmitted when a plurality of media are fed. Therefore, when one medium is fed, the brake roller 113 rotates to be driven by the feed roller 112, in the medium feeding direction. On the other hand, when a plurality of media are fed, the brake roller 113 rotates in a direction A3 opposite to the medium feeding direction to separate a paper in contact with the feed roller 112 from the other paper.

Further, the first conveyance roller 115 rotates in the medium conveying direction A4 by the third pulley 121*c* rotating in the direction of the arrow B1. The second conveyance roller 116 rotates in the medium conveying direction A5, by the first gear 123*a* rotating in the direction of the arrow B2. The third conveyance roller 118 rotates in the medium conveying direction A6, by the fourth pulley 121*d* rotating in the direction of the arrow 91. The tenth gear 123*j* rotates in the direction of the arrow 910, and the fourth conveyance roller 119 rotates in the medium conveying direction A7, by the fourth pulley 121*d* rotating in the direction of the arrow B1.

Conversely, when the first motor 151 generates a second driving force, the first pulley 121*a* rotates in the direction opposite to the arrow B1, accompanied by the rotation of the second to fourth pulley 121*b* to 121*d* in the direction opposite to the arrow B1, respectively. Also, the first to third gears 123*a* to 123*c* and the electromagnetic clutch 124 rotate in the direction opposite to the arrows B2 to B5, the fourth to sixth gears 123*d* to 123*f* rotate in the direction opposite to the arrows B5 to B7, respectively, and the seventh to ninth gears 123*g* to 123*i* rotate in the direction opposite to the arrows B7 to B9, respectively. Thus, the brake roller 113 rotates in the medium feeding direction (the direction opposite to the arrow A3).

The electromagnetic clutch 124 is an example of a driving force interrupt member, which is set to either ON or OFF, by a control signal from the processing circuit to be described later. The electromagnetic clutch 124 transmits a driving force from the first motor 151 to the brake roller 113 when it is set to ON. On the other hand, the electromagnetic clutch 124 interrupts transmission of the driving force from the first motor 151 to the brake roller 113 when it is set to OFF. When the transmission of the driving force from the first motor 151 to the brake roller 113 is interrupted by the electromagnetic clutch 124, the fourth to ninth gears 123*d* to 123*i* and the brake roller 113 do not rotate depending on the driving force from the first motor 151.

When the third pulley 121*c* rotates in the opposite direction of the arrow B1, the first conveyance roller 115 rotates in the opposite direction of the medium conveying direction (the opposite direction of the arrow A4). The second conveyance roller 116 rotates in the direction opposite to the medium conveying direction (in the direction opposite to the arrow A5), by the first gear 123*a* rotating in the direction opposite to the arrow 92. The third conveyance roller 118 rotates in the opposite direction of the medium conveying direction (in the direction opposite to the arrow A6), by the fourth pulley 121*d* rotating in the direction opposite to the arrow B1. The tenth gear 123*j* rotates in the direction opposite to the arrow B10, and the fourth conveyance roller 119 rotates in the direction opposite to the medium conveying direction (in the direction opposite to the arrow A7), by the fourth pulley 121*d* rotating in the direction opposite to the arrow B1.

On the other hand, the second motor 152, as a driving force, generates a third driving force by forward rotation. The forward rotation is a rotation for rotating the fifth pulley 121*e* in the direction of the arrow B11.

When the second motor 152 generates the third driving force, the fifth pulley 121*e* rotates in the direction of the arrow B11, accompanied by the rotation of the sixth pulley 121*f* and the eleventh gear 123*k* in the direction of the arrows B11 and B12, respectively. Also, the twelfth to thirteenth gears 123*l* to 123*m* rotate in the direction of the arrow B13, respectively, and the 14th gear 123*n* rotate in the direction of arrow 914. Thus, the feed roller 112 rotates in the medium feeding direction A2.

Figure 5:
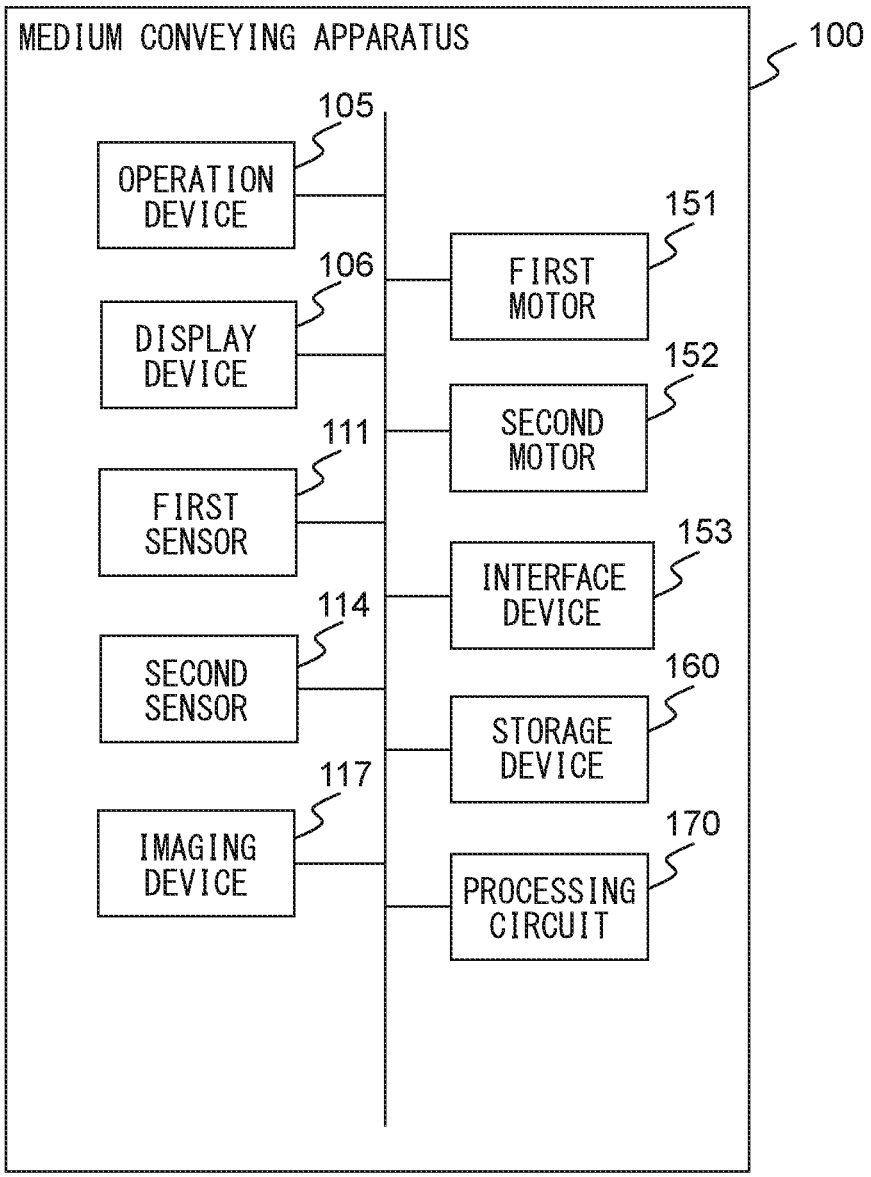
FIG. 5 is a block diagram illustrating a schematic configuration of the medium conveying apparatus 100.

FIG. 5 is a block diagram illustrating a schematic configuration of the medium conveying apparatus 100.

The medium conveying apparatus 100 further includes an interface device 153, a storage device 160, and a processing circuit 170, etc., in addition to the configuration described above.

For example, the interface device 153 includes an interface circuit conforming to a serial bus such as universal serial bus (USB), is electrically connected to an unillustrated information processing apparatus (for example, a personal computer or a mobile information terminal), and transmits and receives an input image and various types of information. Further, a communication module including an antenna transmitting and receiving wireless signals, and a wireless communication interface device for transmitting and receiving signals through a wireless communication line in conformance with a predetermined communication protocol may be used in place of the interface device 153. For example, the predetermined communication protocol is a wireless local area network (LAN).

The storage device 160 includes a memory device such as a random access memory (RAM) or a read only memory (ROM), a fixed disk device such as a hard disk, or a portable storage device such as a flexible disk or an optical disk. Further, the storage device 160 stores a computer program, a database, a table, etc., used for various types of processing in the medium conveying apparatus 100. The computer program may be installed on the storage device 160 from a computer-readable, non-transitory medium such as a compact disc read only memory (CD-ROM), a digital versatile disc read only memory (DVD-ROM), etc., by using a well-known setup program, etc.

The processing circuit 170 operates in accordance with a program previously stored in the storage device 160. The processing circuit 170 is, for example, a CPU (Central Processing Unit). The processing circuit 170 may be a digital signal processor (DSP), a large scale integration (LSI), an application specific integrated circuit (ASIC), a field-programmable gate array (FPGA), etc.

The processing circuit 170 is connected to the operating device 105, the display device 106, the first sensor 111, the second sensor 114, the imaging device 117, the first motor 151, the second motor 152, the interface device 153 and the storage device 160, etc., and controls each of these units. The processing circuit 170 performs drive control of the first motor 151 and the secondary motor 152, imaging control of the imaging device 117, etc., controls the conveyance of the medium, generates an input image, and transmits the input image to the information processing apparatus via the interface device 153.

Figure 6:
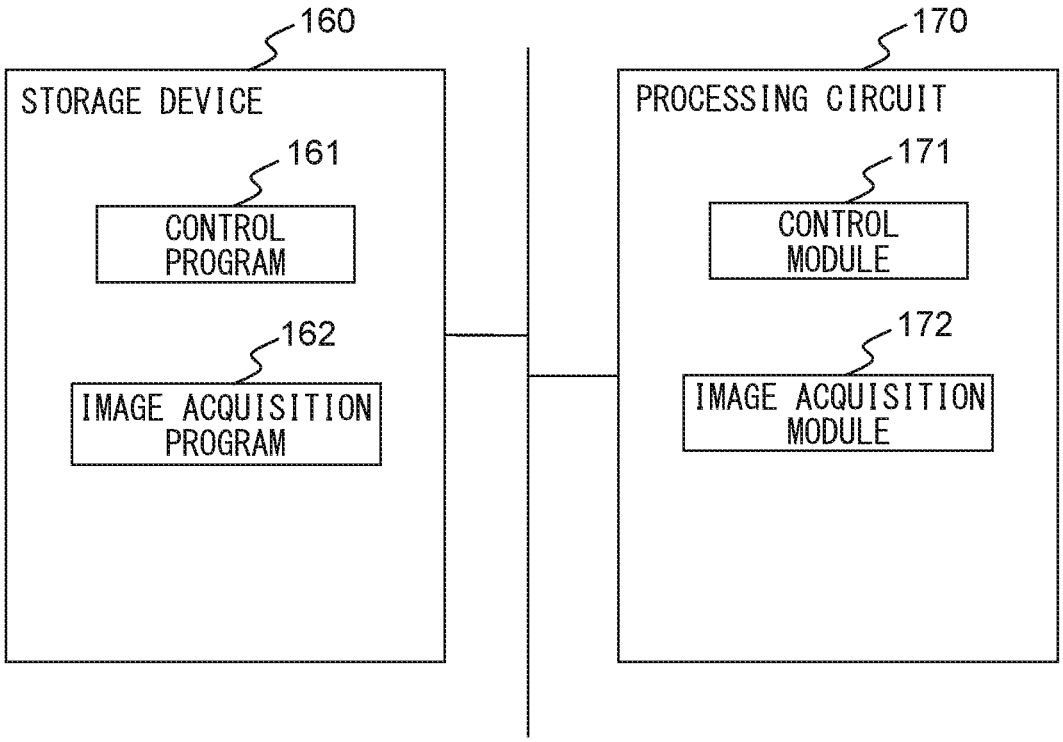
FIG. 6 is a diagram illustrating schematic configurations of the storage device 160 and the processing circuit 170.

FIG. 6 is a diagram illustrating schematic configurations of the storage device 160 and the processing circuit 170.

As illustrated in FIG. 6, a control program 161, an image acquisition program 162, etc., are stored in the storage device 160. Each of these programs is a functional module implemented by software operating on a processor. The processing circuit 170 reads each program stored in the storage device 160 and operates in accordance with each read program. Thus, the processing circuit 170 functions as a control module 171 and an image acquisition module 172.

Figure 7:
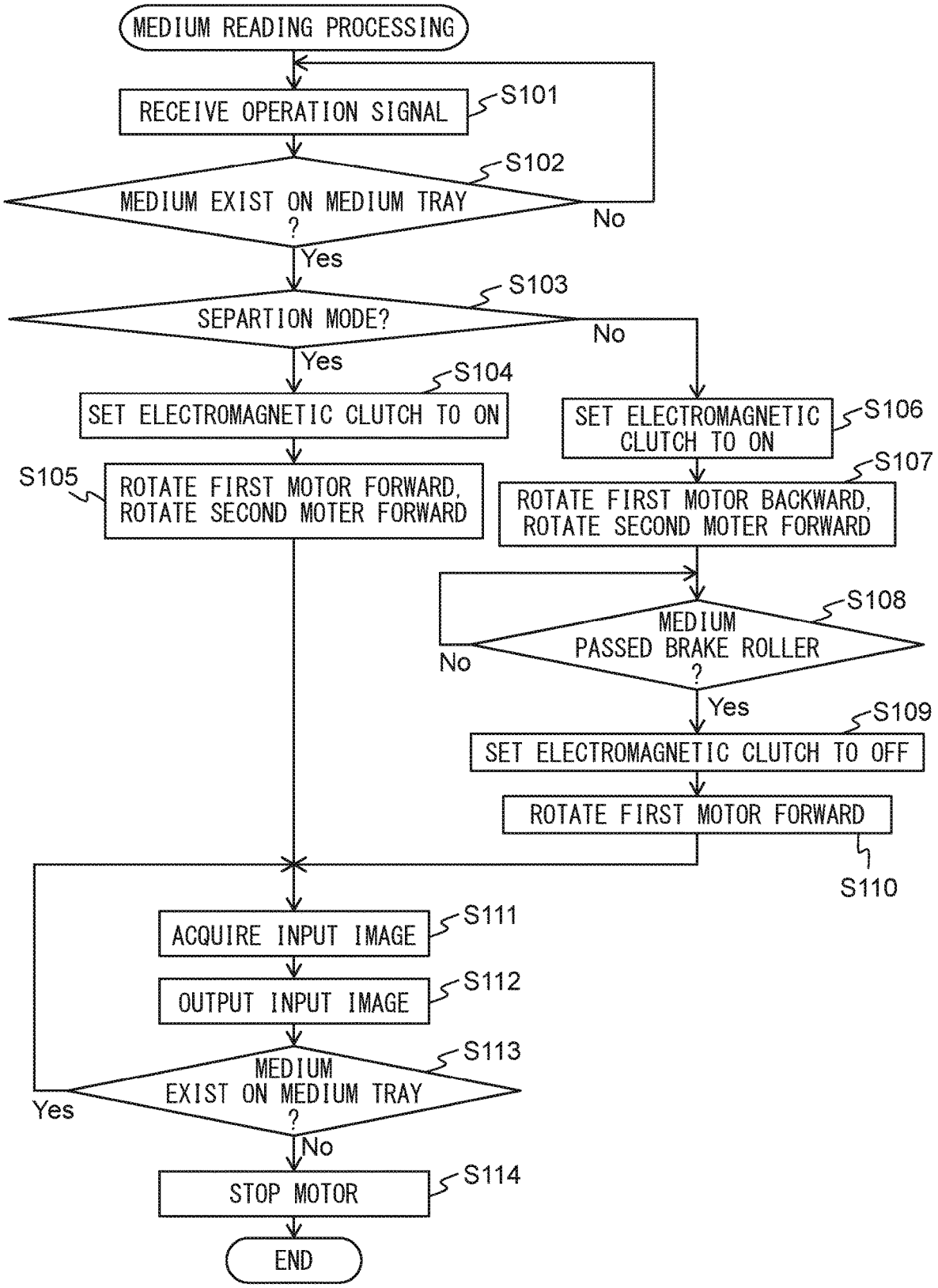
FIG. 7 is a flowchart illustrating an operation example of the medium reading processing.

FIG. 7 is a flowchart illustrating an operation example of medium reading processing in the medium conveying apparatus 100.

Referring to the flowchart illustrated in FIG. 7, an operation example of the skew detection processing in the medium conveying apparatus 100 will be described below. The operation flow described below is executed mainly by the processing circuit 170 in cooperation with each element in the medium conveying apparatus 100, in accordance with a program previously stored in the storage device 160. The operation flow illustrated in FIG. 7 is periodically executed.

Further, the medium conveying device 100 has two operation modes: a separation mode in which the medium is separated and fed when a plurality of media is placed on the medium tray 103, and a non-separation mode in which the medium is fed without separating. Before the flow of the operation shown in FIG. 7 is executed, either of the operation modes is selected by the user using the operation device 105 or an information processing apparatus (not shown) and set.

First, the control module 171 stands by until an instruction to read a medium is input by a user by use of the operation device 105, and an operation signal instructing to read the medium is received from the operation device 105 (step S101).

Next, the control module 171 acquires the first medium signal from the first sensor 111 and determines whether or not a medium is placed on the medium tray 103 based on the acquired first medium signal (step S102).

When a medium is not placed on the medium tray 103, the control module 171 returns the processing to step S101 and stands by until newly receiving an operation signal from the operation device 105.

On the other hand, when a medium is placed on the medium tray 103, the control module 171 determines whether the present operation mode set in the medium conveying device 100 is the separation mode or the non-separation mode (step S103).

When the operation mode is the separated mode, the control module 171 sets the electromagnetic clutch 124 to ON so as to transmit the driving force from the first motor 151 to the brake roller 113 (step S104).

Next, the control module 171 drives the first motor 151 and the second motor 152 (step S105), and the process proceeds to step S111. The control module 171 rotates the first motor 151 forward to cause the first motor 151 to generate a first driving force. As a result, the control module 171 rotates the brake roller 113 in the direction A3 opposite to the medium feeding direction, and rotates the first to fourth conveyance rollers 115, 116, 118 and 119 in the medium conveying direction A5 to A7. Further, the control module 171 rotates the second motor 152 forward to cause the second motor 152 to generate a third driving force. Thus, the control module 171 rotates the feed roller 112 in the medium feeding direction A2. Thus, in the separation mode, the control module 171 rotates the first motor 151 forward to control so that the medium separated by the brake roller 113 is conveyed by the first to fourth conveyance rollers 115, 116, 118 and 119.

On the other hand, when the operation mode is the non-separation mode, the control module 171 sets the electromagnetic clutch 124 to ON so as to transmit the driving force from the first motor 151 to the brake roller 113 (step S106).

Next, the control module 171 drives the first motor 151 and the second motor 152 (step S107). The control module 171 rotates the first motor 151 backward to cause the first motor 151 to generate a second driving force. Thus, the control module 171 rotates the brake roller 113 in the medium feeding direction and rotates the first to fourth conveyance rollers 115, 116, 118 and 119 in the direction opposite to the medium conveying direction. Further, the control module 171 rotates the second motor 152 forward to generate a third driving force to the second motor 152 and rotates the feed roller 112 in the medium feeding direction A2.

Next, the control module 171 determines whether or not a front edge of the medium has passed through the positions of the feed roller 112 and the brake roller 113 (step S108). The control module 171 determines whether or not the front edge of the medium has passed through the positions of the feed roller 112 and the brake roller 113 based on the detection result of the second sensor 114. The control module 171 periodically acquires the second medium signal from the second sensor 114 and determines whether or not the medium is present at the position of the second sensor 114 based on the acquired second medium signal. When the signal value of the second medium signal changes from a value indicating that a medium is not present to a value indicating that a medium is present, the control module 171 determines that the front edge of the medium has passed through the position of the second sensor 114 and has passed through the positions of the feed roller 112 and the brake roller 113. The control module 171 waits until it is determined that the front edge of the medium has passed through the positions of the feed roller 112 and the brake roller 113.

The control module 171 may determine whether or not the front edge of the medium has passed through the positions of the feed roller 112 and the brake roller 113 without using the second sensor 114. For example, the control module 171 may determine that the front edge of the medium has passed through the positions of the feed roller 112 and the brake roller 113 when a predetermined time has elapsed after the feeding of the medium (the driving of the first motor 151 and the second motor 152) is started. The predetermined time is set to the time required for the front edge of the medium to pass through the positions of the feed roller 112 and the brake roller 113 after the feeding of the medium is started by the prior experiment. Further, the control module 171 may determine that the front edge of the medium has passed through the positions of the feed roller 112 and the brake roller 113 when the first motor 151 and the second motor 152 are rotated by a predetermined amount. The predetermined amount is set to the amount of rotation required for the front edge of the medium to pass through the positions of the feed roller 112 and the brake roller 113 after the feeding of the medium is started by the prior experiment.

On the other hand, the control module 171 sets the electromagnetic clutch 124 to OFF so as to interrupt the transmission of the driving force from the first motor 151 to the brake roller 113 when the control module 171 determines that the front edge of the medium has passed through the positions of the feed roller 112 and the brake roller 113 (step S109).

Next, the control module 171 rotates the first motor 151 forward to switch the driving force generated in the first motor 151 from the second driving force to the first driving force (step S110). Thus, the control module 171 interrupts the transmission of the driving force from the first motor 151 to the brake roller 113 and rotates the first to fourth conveyance rollers 115, 116, 118 and 119 in the medium conveying direction. Further, the control module 171 rotates the second motor 152 forward to cause the second motor 152 to generate the third driving force and rotate the feed roller 112 in the medium feeding direction A2.

Thus, the control module 171 rotates the first motor 151 backward to perform the feed operation by the brake roller 113 and rotate the first to fourth conveyance rollers 115, 116, 118 and 119 backward until the front edge of the medium passes through the position of the brake roller 113, in the non-separation mode. Further, the control module 171 rotates the first motor 151 forward to control so that the medium is conveyed by the first to fourth conveyance rollers 115, 116, 118 and 119 after the front edge of the medium passes through the position of the brake roller 113.

Further, the electromagnetic clutch 124 interrupts transmission of the driving force from the first motor 151 to the brake roller 113 when the first motor 151 is rotated forward to convey the medium by the first to fourth conveyance rollers 115, 116, 118 and 119, in a non-separable mode.

Next, the image acquisition module 172 causes the imaging device 117 to start imaging of the medium, and acquires an input image from the imaging device 117 (step S111).

Next, the image acquisition module 172 transmits the input image to the information processing apparatus through the interface device 153 (step S112). When not being connected to the information processing apparatus, the image acquisition module 162 stores the input image in the storage device 160.

Next, the control module 171 determines whether or not the medium remains in the medium tray 103 based on the first medium signal acquired from the first sensor 111 (step S113). When a medium remains on the medium tray 103, the control module 171 returns the processing to step S111 and repeats the processing in steps S111 to S113.

On the other hand, if the medium does not remain on the medium tray 103, the control module 171 stops the first motor 151 and the second motor 152 (step S114), and ends the series of steps.

FIGS. 8A, 8B, 9A and 9B are schematic views for illustrating the operations of the feed roller 112, the brake roller 113, the first conveyance roller 115, and the second conveyance roller 116.

Figure 8A:
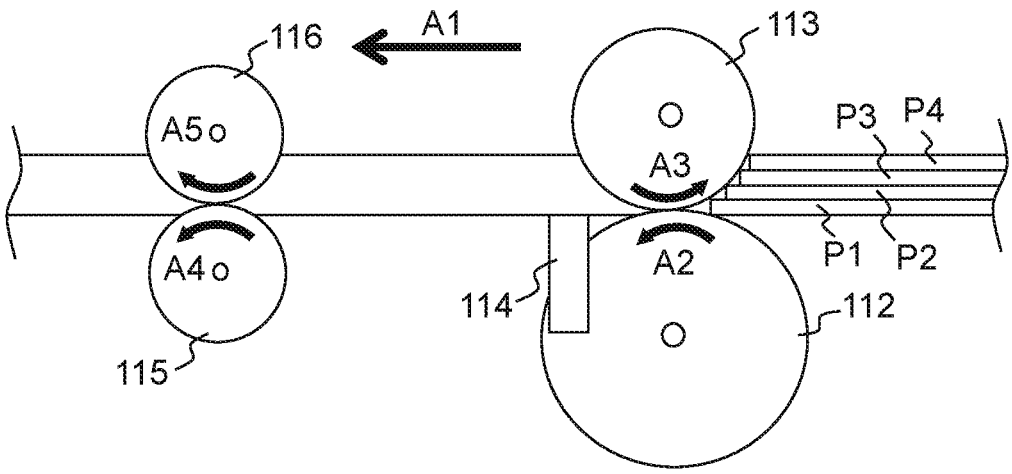
FIG. 8A is a schematic diagram for illustrating the operations of each roller.
Figure 8B:
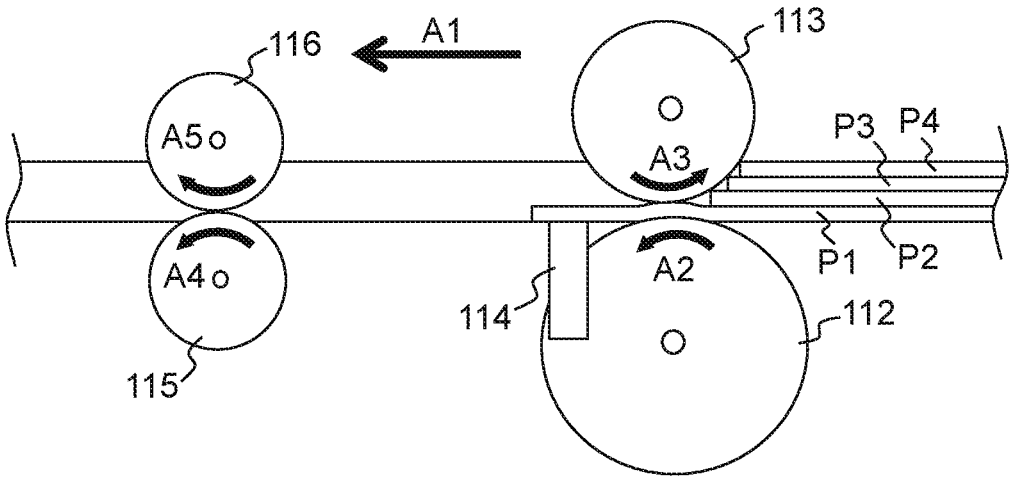
FIG. 8B is a schematic diagram for illustrating the operations of each roller.

FIGS. 8A and 8B are schematic diagrams for explaining the operation of the respective rollers in the separating mode. FIG. 8A is a schematic diagram for illustrating the operations of each roller when the feeding of the medium is started, and FIG. 8B is a schematic diagram for illustrating the operations of each roller after the front edge of the medium passes through the position of the brake roller 113. Normally, the separation mode is set when a plurality of papers are placed on the medium tray 103 collectively and conveyed. In the exemplary embodiment illustrated in FIGS. 8A and 8B, a plurality of papers P1 to P4 are collectively placed on the medium tray 103.

As shown in FIGS. 8A and 8B, in the separating mode, the feed roller 112 always rotates in the medium feeding direction A2, and the braking roller 113 always rotates in the direction A3 opposite to the medium feeding direction. Accordingly, only the medium P1 in contact with the feed roller 112 among the plurality of media P1 to P4 placed on the medium tray 103 is separated and fed. Further, the first conveyance roller 115 and the second conveyance roller 116 rotate in the medium conveying directions A4 and A5, respectively. Thus, the first conveyance roller 115 and the second conveyance roller 116 convey the medium P1 separated and fed by the feed roller 112 and the brake roller 113 to the downstream side.

In this manner, in the separation mode, the brake roller 113 rotates in the direction A3 opposite to the medium feeding direction not only when the feeding of the medium is started but also after the front edge of the medium passes through the position of the brake roller 113. Thus, the brake roller 113 can prevent the next medium from being erroneously fed after the leading end of the medium passes through the position of the brake roller 113.

Figure 9A:
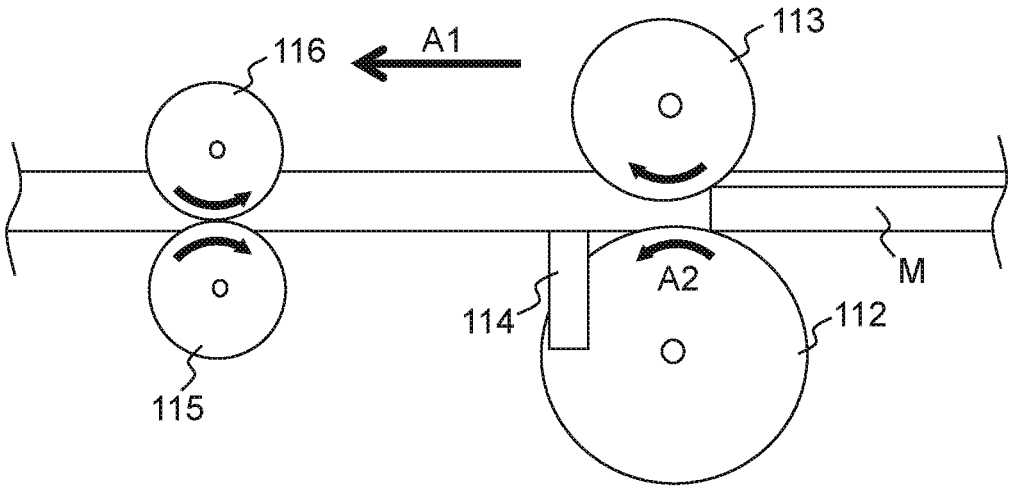
FIG. 9A is a schematic diagram for illustrating the operations of each roller.
Figure 9B:
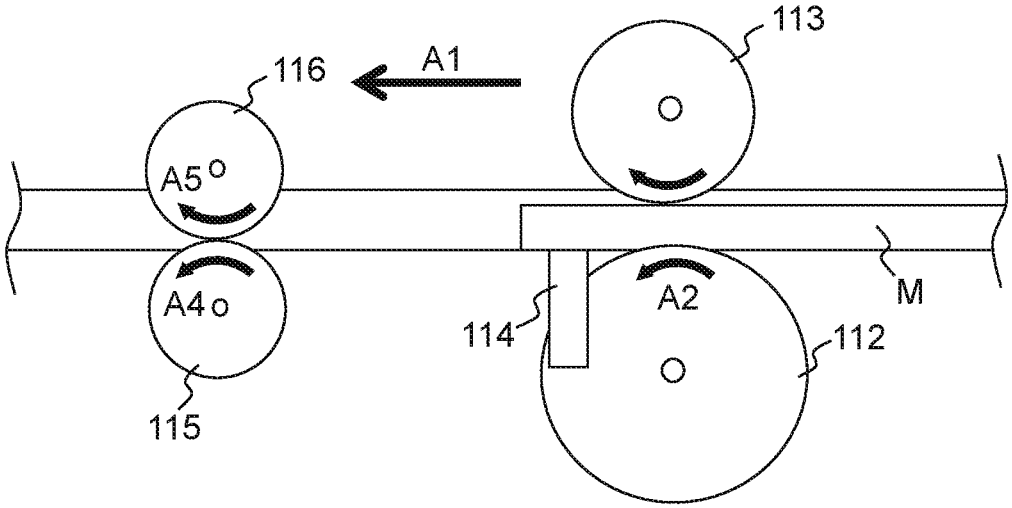
FIG. 9B is a schematic diagram for illustrating the operations of each roller.

FIGS. 9A and 9B are schematic diagrams for illustrating the operations of each rollers in the non-separation mode. FIG. 9A is a schematic diagram for illustrating the operations of each roller when the feeding of the medium is started, and FIG. 9B is a schematic diagram for illustrating the operations of each roller after the front edge of the medium passes through the position of the brake roller 113. Normally, the non-separable mode is set when a thick single medium, such as a plastic card or passport, is placed on the pedestal 103 and conveyed. In the exemplary embodiment illustrated in FIGS. 9A and 9B, the passport M is placed on the medium tray 103.

As shown in FIG. 9A, in the non-separation mode, the feed roller 112 rotates in the medium feeding direction A2 and the brake roller 113 rotates in the medium feeding direction until the front edge of the medium passes through the position of the brake roller 113. The feed roller 112 and the brake roller 113 can generate sufficient feed force to feed the medium to suitably feed a thick medium, such as a passport M, since the feed roller 112 and the brake roller 113 interpose and feed the medium, At this time, the first conveyance roller 115 and the second conveyance roller 116 rotate in the directions opposite to the medium conveying directions A4 and A5, respectively. However, the passport M is fed without any problem since it has not reached the positions of the first conveyance roller 115 and the second conveyance roller 116.

On the other hand, as shown in FIG. 9B, after the front edge of the medium passes through the position of the brake roller 113, the feed roller 112 rotates in the medium feeding direction A2, and the driving force from the first motor 151 is interrupted, and is not transmitted to the brake roller 113. Thus, the passport M is fed by the feed roller 112, and the brake roller 113 rotates together (is driven) by the fed passport M. Further, the first conveyance roller 115 and the second conveyance roller 116 rotate in the medium conveying directions A4 and A5, respectively. Thus, the first conveyance roller 115 and the second conveyance roller 116 convey the passport M fed by the feed roller 112 to the downstream side.

As described in detail above, the medium conveying device 100 drives the brake roller 113 and the first to fourth conveyance rollers 115, 116, 118 and 119 with single first motor 151. The medium conveying device 100 causes the first to fourth conveyance rollers 115, 116, 118 and 119 to convey the medium while causing the brake roller 113 to separate the medium in the separation mode in which the plurality of media are separated and conveyed. On the other hand, the medium conveying device 100 causes the brake rollers 113 to feed the medium until the medium passes through the separation module and rotates the first to fourth conveyance rollers 115, 116, 118 and 119 backward, in a non-separation mode in which a medium, such as a passport, is conveyed. After the medium passes through the separation module, the medium conveying device 100 rotates the motor backward to cause the first to fourth conveyance rollers 115, 116, 118 and 119 to convey the medium. Thus, the medium conveying apparatus 100 can appropriately control the rotation of the brake roller 113 and the first to fourth conveyance rollers 115, 116, 118 and 119 with single first motor 151 in each of the separation mode and the non-separation mode.

Further, the medium conveying apparatus 100 can reduce the weight and cost of the apparatus by controlling the rotation of the plurality of rollers with single first motor 151. Further, the medium conveying apparatus 100 can properly feed and convey, as a medium, not only paper but also a thick document such as a plastic card or a passport.

Further, in the medium conveying device 100, the first motor 151 for controlling the rotation of the first to fourth conveyance rollers 115, 116, 118 and 119 and the second motor 152 for controlling the rotation of the feed roller 112 are separately provided. Thus, the medium conveying device 100 can control the rotational speeds of the feed rollers 112 and the first to fourth conveyance rollers 115, 116, 118 and 119 so that each medium is conveyed at a high speed while maintaining an appropriate distance between the front media and distance between the rear media when a plurality of media are conveyed.

Figure 10:
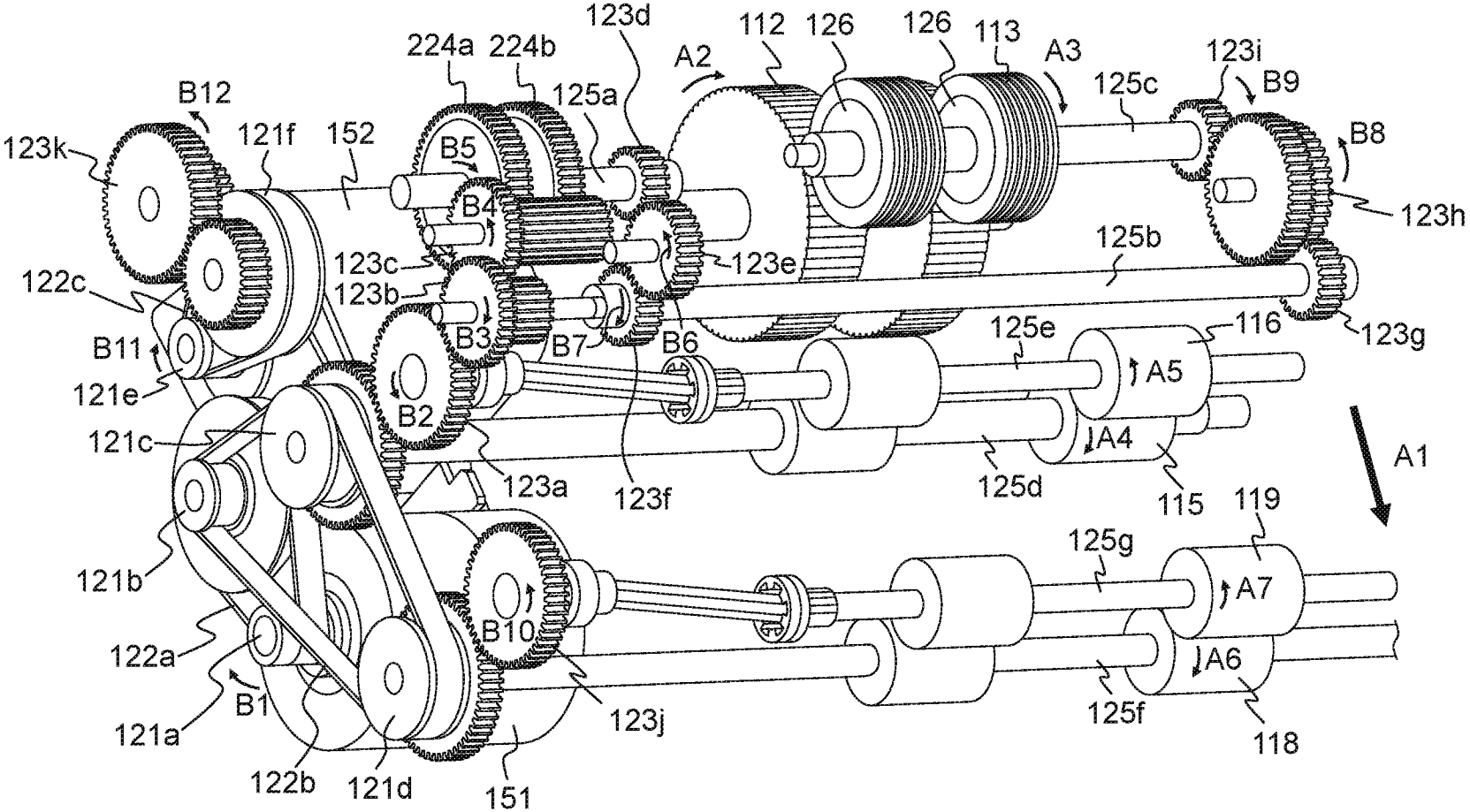
FIG. 10 is a schematic diagram for illustrating a driving mechanism of another each roller.

FIG. 10 is a schematic diagram for illustrating a driving mechanism of the feed roller 112, the brake roller 113, and the first to fourth conveyance rollers 115, 116, 118 and 119 in the medium conveying apparatus according to another embodiment. FIG. 10 is a perspective view of a driving mechanism of each roller from above the conveyance path.

As shown in FIG. 10, the medium conveying apparatus according to the present embodiment includes a first mechanical clutch 224*a* and a second mechanical clutch 224*b* instead of the electromagnetic clutch 124. The first mechanical clutch 224*a* and the second mechanical clutch 224*b* are examples of driving force interrupt member.

The first mechanical clutch 224*a* is a one-way clutch provided so as to transmit the rotational drive in the direction of the arrow B5 to the first shaft 125*a*. The first mechanical clutch 224*a* empties with respect to the first shaft 125*a*, and blocks the transmission of the driving force from the first motor 151 to the brake roller 113 when rotating more than a first amount in a direction opposite to arrow B5 and then rotating more than the first amount in a direction of the arrow B5. On the other hand, the first mechanical clutch 224*a* rotates with the first shaft 125*a* to transmit the driving force from the first motor 151 to the brake roller 113 when rotating by a second amount smaller than the first amount in the direction opposite to the arrow B5 and then rotating more than the first amount in the direction of the arrow B5.

The second mechanical clutch 224*b* is a one-way clutch provided so as to transmit the rotational drive in the direction opposite to the arrow B5 to the first shaft 125*a*. The second mechanical clutch 224*b* empties with respect to the first shaft 125*a* and interrupts the transmission of the driving force from the first motor 151 to the brake roller 113 when rotating more than the first amount in the direction of arrow B5 and then rotating more than the first amount in the direction opposite to the arrow B5. On the other hand, the second mechanical clutch 224*b* rotates with the first shaft 125*a* to transmit the driving force from the first motor 151 to the brake roller 113 when rotating by the second amount smaller than the first amount in the direction of the arrow B5 and then rotating more than the first amount in the direction opposite to the arrow B5.

When the operation mode is the separation mode, the control module 171 causes the second mechanical clutch 224*b* to interrupt the driving force from the first motor 151 while causing the first mechanical clutch 224*a* to transmit the driving force from the first motor 151 in step S104 of FIG. 7. Thus, the control module 171 rotates the brake roller 113 in the direction A3 opposite to the medium feeding direction.

On the other hand, when the operation mode is the non-separation mode, the control module 171 causes the first mechanical clutch 224*a* to interrupt the driving force from the first motor 151 while causing the second mechanical clutch 224*b* to transmit the driving force from the first motor 151 in step S106 of FIG. 7. Thus, the control module 171 rotates the brake roller 113 in the medium feeding direction (the direction opposite to the arrow A3). Further, the control module 171 causes the first mechanical clutch 224*a* and the second mechanical clutch 224*b* to interrupt the driving force from the first motor 151, in step S109 of FIG. 7. Thus, the control module 171 causes the brake roller 113 to be driven by the conveyed medium.

As described in detail above, even when mechanical clutches are used as a driving force interrupt member, the medium conveying device can appropriately control the rotation of the brake roller 113 and each conveyance roller by single first motor 151 in each of the separation mode and the non-separation mode.

Another member such as a solenoid may be used instead of the electromagnetic clutch 124 or the first mechanical clutch 224*a* and the second mechanical clutch 224*b*, as the driving force interrupt member.

Further, a driving force interrupt member may be omitted, and a single gear may be used in place of the electromagnetic clutch 124. In such cases, steps S104, S106 and S109 of FIG. 7 are omitted, and the driving force from the first motor 151 is constantly transmitted to the braking roller 113.

Figure 11:
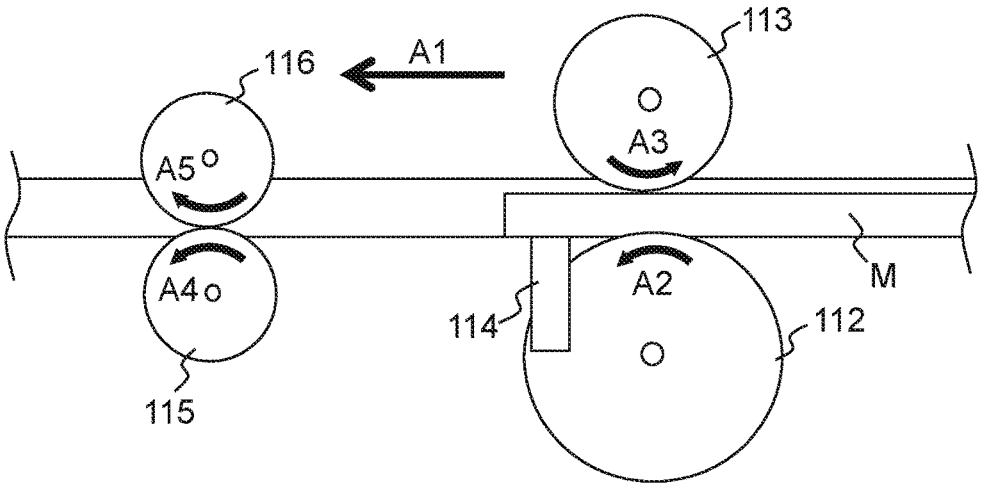
FIG. 11 is a schematic diagram for illustrating operations of each roller when a driving force is interrupted.

FIG. 11 is a schematic diagram for illustrating the operations of the feed roller 112, the brake roller 113, the first conveyance roller 115 and the second conveyance roller 116 when the driving force interrupt member is omitted. FIG. 11 is a schematic diagram for illustrating the operations of each roller after the front edge of the medium passes through the position of the brake roller 113 in the non-separation mode.

As shown in FIG. 11, when the driving force interrupt member is omitted, even after the front edge of the medium passes through the position of the brake roller 113, the driving force from the first motor 151 is transmitted to the brake roller 113, and the brake roller 113 rotates in the direction A3 opposite to the medium feeding direction. However, when the fed medium is a plastic card, etc., the force applied to the brake roller 113 by the fed medium exceeds the limit value of the torque limiter 126. In this case, the rotational force through the torque limiter 126 is interrupted, the brake roller 113 is rotated together (driven) by the fed medium.

As described in detail above, even when the driving force interrupt member is omitted in the medium conveying device, the medium conveying device can appropriately control the rotation of the brake roller 113 and each conveyance roller by single first motor 151 in each of the separation mode and the non-separation mode.

In particular, the medium conveying apparatus can generate sufficient feeding force for suitably feeding when a plastic card is conveyed. When a plurality of sheets are conveyed, the medium conveyance device continues to rotate the brake roller 113 in the direction A3 opposite to the medium feeding direction even after the front edge of the paper passes through the separation module. Therefore, even when a plurality of papers passes through the separation module, the medium conveying device can continue to separate the medium and suppress the occurrence of multi-feed.

Figure 12:
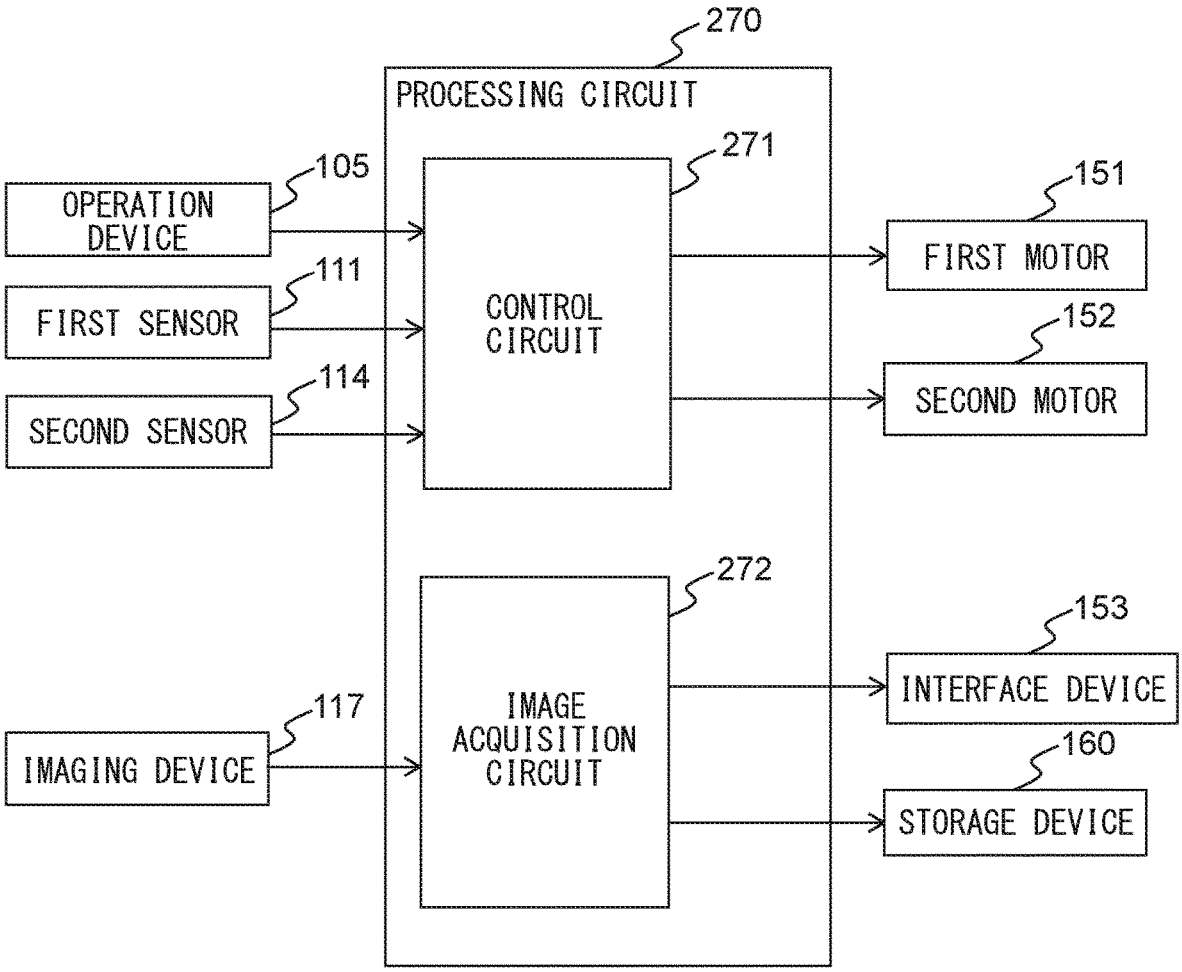
FIG. 12 is a diagram illustrating a schematic configuration of yet another processing circuit 270.

FIG. 12 is a diagram illustrating a schematic configuration of a processing circuit 270 in a medium conveying apparatus according to another embodiment. The processing circuit 270 is used in place of the processing circuit 170 in the medium conveying apparatus 100 and executes the medium reading processing in place of the processing circuit 170. Processing circuit 270 includes a control circuit 271 and an image acquisition circuit 272, etc. Note that each unit may be configured by an independent integrated circuit, a microprocessor, firmware, etc.

The control circuit 271 is an example of a control module and has a function similar to the control module 171. The control circuit 271 receives the operation signal from the operating device 105, the first medium signal from the first sensor 111, and the second medium signal from the second sensor 114. The control circuit 271 rotates the first motor 151 and the second motor 152 in accordance with each received signal to control the conveyance of the medium by each roller.

The image acquisition circuit 272 is an example of an image acquisition module and has a function similar to the image acquisition module 172. The image acquisition circuit 272 receives an input image from the imaging device 117 and transmits the input image to the information processing apparatus through the interface device 153 or stores the input image into the storage device 160.

As described in detail above, even when the processing circuit 270 is used, the medium conveying apparatus can appropriately control the rotation of the brake roller 113 and each conveyance roller by single first motor 151 in each of the separation mode and the non-separation mode.

According to the embodiments, the media conveying apparatus, the method and the computer-readable non-temporary recording medium can appropriately control the rotation of the plurality of rollers with a single motor in each of the separation mode and non-separation mode.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveying apparatus comprising:

a brake roller;

a pair of conveyance rollers located on the downstream side of the brake roller in a medium conveying direction;

a first motor;

a driving force transmitting mechanism to transmit a driving force from the first motor to the brake roller and the pair of conveyance rollers;

a processor to rotate the first motor forward to control so that a medium separated by the brake roller is conveyed by the pair of conveyance rollers, in a separation mode, wherein the processor rotates the first motor backward to perform a feed operation by the brake roller and rotate the pair of conveyance rollers backward until a front edge of the medium passes through a position of the brake roller, and rotates the first motor forward to control so that the medium is conveyed by the pair of conveyance rollers after the front edge of the medium passes through the position of the brake roller, in a non-separation mode.

2. The medium conveying apparatus according to claim 1, further comprising:

a feed roller located to face the brake roller; and a second motor to generate a driving force for rotating the feed roller.

3. The medium conveying apparatus according to claim 1, wherein the driving force transmitting mechanism includes a driving force interrupt member to interrupt transmission of a driving force from the first motor to the brake roller when the first motor is rotated forward to convey the medium by the pair of conveyance rollers after the front edge of the medium passes through the position of the brake roller in the non-separation mode.

4. The medium conveying apparatus according to claim 1, further comprising a medium sensor to detect a medium passing through between the brake roller and the pair of conveyance rollers, wherein the processor determines whether the front edge of the medium has passed through the position of the brake roller based on a detection result of the medium sensor.

5. A method for controlling conveying a medium, comprising:

transmitting a driving force from a first motor to a brake roller and a pair of conveyance rollers located on the downstream side of the brake roller in a medium conveying direction, by a driving force transmitting mechanism;

rotating the first motor forward to control so that a medium separated by the brake roller is conveyed by the pair of conveyance rollers, in a separation mode; and rotating the first motor backward to perform a feed operation by the brake roller and rotate the pair of conveyance rollers backward until a front edge of the medium passes through a position of the brake roller, and rotating the first motor forward to control so that the medium is conveyed by the pair of conveyance rollers after the front edge of the medium passes through the position of the brake roller, in a non-separation mode.

6. The method according to claim 5, further comprising generating a driving force for rotating a feed roller located to face the brake roller, by a second motor.

7. The method according to claim 5, wherein the driving force transmitting mechanism includes a driving force interrupt member to interrupt transmission of a driving force from the first motor to the brake roller when the first motor is rotated forward to convey the medium by the pair of conveyance rollers after the front edge of the medium passes through the position of the brake roller in the non-separation mode.

8. The method according to claim 5, further comprising detecting a medium passing through between the brake roller and the pair of conveyance rollers, wherein whether the front edge of the medium has passed through the position of the brake roller is determined based on a detection result of the medium sensor.

9. A computer-readable, non-transitory medium storing a computer program, wherein the computer program causes a medium conveying apparatus including a brake roller, a pair of conveyance rollers located on the downstream side of the brake roller in a medium conveying direction, a first motor, and a driving force transmitting mechanism to transmit a driving force from the first motor to the brake roller and the pair of conveyance rollers, to execute a process, the process comprising:

rotating the first motor forward to control so that a medium separated by the brake roller is conveyed by the pair of conveyance rollers, in a separation mode; and rotating the first motor backward to perform a feed operation by the brake roller and rotate the pair of conveyance rollers backward until a front edge of the medium passes through a position of the brake roller, and rotating the first motor forward to control so that the medium is conveyed by the pair of conveyance rollers after the front edge of the medium passes through the position of the brake roller, in a non-separation mode.

10. The computer-readable, non-transitory medium according to claim 9, wherein the medium conveying apparatus further includes a feed roller located to face the brake roller, and a second motor to generate a driving force for rotating the feed roller.

11. The computer-readable, non-transitory medium according to claim 9, wherein the driving force transmitting mechanism includes a driving force interrupt member to interrupt transmission of a driving force from the first motor to the brake roller when the first motor is rotated forward to convey the medium by the pair of conveyance rollers after the front edge of the medium passes through the position of the brake roller in the non-separation mode.

12. The computer-readable, non-transitory medium according to claim 9, a medium sensor to detect a medium passing through between the brake roller and the pair of conveyance rollers, wherein whether the front edge of the medium has passed through the position of the brake roller is determined based on a detection result of the medium sensor.

* * * * *